US009464460B2

(12) United States Patent
Lai

(10) Patent No.: US 9,464,460 B2
(45) Date of Patent: Oct. 11, 2016

(54) PADLOCK WITH FULLY INTEGRATED DUAL LOCKING MECHANISM WITH A LOST CODE DEFINING SYSTEM

(71) Applicant: The Sun Lock Company Ltd., Tuen Mun, N.T. (HK)

(72) Inventor: Karl Lai, Tai Po (HK)

(73) Assignee: The Sun Lock Company Ltd., Tuen Mun, N.T. (HK)

( * ) Notice: Subject to any disclaimer, the term of this patent is extended or adjusted under 35 U.S.C. 154(b) by 0 days.

(21) Appl. No.: 14/699,253

(22) Filed: Apr. 29, 2015

(65) Prior Publication Data

US 2015/0322692 A1 Nov. 12, 2015

Related U.S. Application Data

(60) Provisional application No. 61/989,803, filed on May 7, 2014, provisional application No. 62/118,625, filed on Feb. 20, 2015.

(51) Int. Cl.

| | |
|---|---|
| ***E05B 37/02*** | (2006.01) |
| ***E05B 37/00*** | (2006.01) |
| ***E05B 67/02*** | (2006.01) |

(Continued)

(52) U.S. Cl.

CPC ..... *E05B 37/025* (2013.01); *E05B 37/0034* (2013.01); *E05B 67/02* (2013.01); *E05B 67/08* (2013.01); *E05B 67/22* (2013.01); *E05B 37/0058* (2013.01); *Y10T 70/415* (2015.04)

(58) Field of Classification Search

CPC ..... E05B 37/025; E05B 37/0034; E05B 35/105; E05B 67/24; E05B 37/10; E05B 37/0031; E05B 37/02; E05B 37/0058; E05B 37/04; E05B 67/02; E05B 67/08; Y10T 70/415; Y10T 70/7141; Y10T 70/7147; Y10T 70/7305

USPC ..... 70/21, 284, 285

See application file for complete search history.

(56) References Cited

U.S. PATENT DOCUMENTS

| | | | |
|---|---|---|---|
| 1,653,254 | A | 12/1927 | Chisholm |
| 1,728,902 | A | 9/1929 | Cohen |
| 4,444,029 | A | 4/1984 | Remington |

(Continued)

FOREIGN PATENT DOCUMENTS

| | | |
|---|---|---|
| CN | 101315007 | 12/2008 |
| EP | 1837466 | 9/2007 |

(Continued)

*Primary Examiner* — Suzanne Barrett

(74) *Attorney, Agent, or Firm* — Ware, Fressola, Maguire & Barber LLP

(57) ABSTRACT

A dual locking padlock having a code locking mechanism and an overriding mechanism is disclosed. The housing has a spacer as its top portion, a stack of clutches forming a middle portion and a bottom portion having holes to receive screws from the spacer for securing the housing. Dials are rotatably mounted on the clutches for changing the combination code. The housing has a spindle having a channel to store the heel of a shackle. The spindle's upward movement allows the shackle to be pulled upward to unlock the padlock. The spindle is allowed to move upward either when a correct combination code is used or when a key activates the overriding mechanism. With the overriding mechanism, the user can open the padlock with a backup key if the user forgets the combination code, and then reset the dials to a new combination code.

20 Claims, 14 Drawing Sheets

(51) Int. Cl.
*E05B 67/08* (2006.01)
*E05B 67/22* (2006.01)

(56) References Cited

U.S. PATENT DOCUMENTS 4,733,548 A 3/1988 Ling
4,829,794 A 5/1989 Crown
5,715,709 A 2/1998 Lai
6,029,481 A * 2/2000 Lai ..... E05B 37/025 70/25
6,176,109 B1 1/2001 Tsui
6,474,116 B1 11/2002 Lai
6,675,614 B2 1/2004 Lai
6,729,166 B1 5/2004 Lai
6,883,355 B2 4/2005 Lai
6,904,776 B1 * 6/2005 Lin ..... E05B 37/025 70/21
7,117,698 B2 10/2006 Lai
7,121,123 B2 * 10/2006 Yu ..... E05B 37/025 70/21
7,140,209 B2 11/2006 Lai
7,155,944 B1 * 1/2007 Lin ..... E05B 37/0031 70/21
7,225,648 B2 6/2007 Lai et al.
7,370,498 B1 * 5/2008 Miao ..... E05B 37/0034 70/21
7,467,531 B2 12/2008 Lai et al.
7,562,545 B2 7/2009 Lai et al.
7,685,851 B2 3/2010 Lai
7,765,840 B2 8/2010 Lai et al.
8,261,583 B2 * 9/2012 Lai ..... E05B 35/105 70/21
8,511,118 B2 * 8/2013 Lai ..... E05B 35/105 70/21
8,661,861 B2 3/2014 Lai
8,776,556 B2 7/2014 Lai
8,881,558 B2 11/2014 Misner et al.
8,919,155 B2 12/2014 Lai
8,931,313 B2 1/2015 Lai
8,966,946 B2 3/2015 Lai
9,206,625 B2 12/2015 Lai
2003/0150245 A1 8/2003 Lai
2004/0031298 A1 2/2004 Lai
2005/0092036 A1 5/2005 Lai
2006/0027000 A1 * 2/2006 Yu ..... E05B 37/025 70/21
2006/0027001 A1 * 2/2006 Lai ..... E05B 37/0034 70/25
2006/0150690 A1 * 7/2006 Lai ..... E05B 35/105 70/21
2006/0243005 A1 11/2006 Lai et al.
2006/0260369 A1 * 11/2006 Lai ..... E05B 37/025 70/38 C
2008/0011025 A1 * 1/2008 Lin ..... E05B 35/105 70/21
2008/0083251 A1 4/2008 Lai et al.
2008/0098774 A1 * 5/2008 Huang ..... E05B 35/105 70/21
2008/0250825 A1 10/2008 Lai
2009/0113947 A1 5/2009 Lai et al.
2010/0095718 A1 * 4/2010 Lai ..... E05B 35/105 70/21
2012/0304711 A1 * 12/2012 Misner ..... E05B 35/105 70/21
2013/0025333 A1 1/2013 Lai
2013/0036778 A1 2/2013 Lai
2013/0118215 A1 5/2013 Lai
2014/0026626 A1 1/2014 Lai
2014/0250952 A1 9/2014 Lai
2014/0352371 A1 12/2014 Lai
2014/0366592 A1 * 12/2014 Bao ..... E05B 37/10 70/25
2014/0373579 A1 12/2014 Lai
2015/0322692 A1 * 11/2015 Lai ..... E05B 67/22 70/21
2015/0330104 A1 11/2015 Lai

FOREIGN PATENT DOCUMENTS

EP 2738326 6/2014
GB 203929 9/1923
GB 2493266 1/2013
GB 2498242 7/2013
GB 2519128 4/2015
JP 07-305553 11/1995
JP 5009385 8/2012
TW M247658 10/2004

* cited by examiner

PADLOCK WITH FULLY INTEGRATED DUAL LOCKING MECHANISM WITH A LOST CODE DEFINING SYSTEM

TECHNICAL FIELD

The present invention relates to padlocks, in particular a padlock with a dual locking mechanism.

BACKGROUND OF THE INVENTION

Numerous padlock constructions have been developed and are widely employed to prevent unauthorized persons from gaining access to any particular item or area which has been closed and locked. Although many locks are constructed to be opened by a key, numerous combination lock constructions have been developed which are opened by knowledge of a particular combination.

One particular type of combination lock that has become very popular due to its ease and convenience of use is a combination lock which employs a plurality of rotatable independent dials, each of which forms one of the indicia, usually numerals or letters, which comprise the combination for releasing the lock. Typically, the combination lock has one mode or position in which the user is able to set or reset the desired combination sequence.

In airplane travel, new regulations and requirements allow customs officers or transit security personnel to physically break any padlock in order to gain access to luggage which is deemed suspicious. Under these new security regulations, all luggage must be scanned or inspected to prevent the transportation of potentially dangerous items or products which are deemed to be undesirable. Currently a padlock may have two separate and independent locking systems, with both locking systems independently enabling a single shackle to be released and/or lockingly engaged. In this way, by employing either a key activation zone or a combination activation zone, the padlock can be opened. The key activation zone allows security personnel to open the padlock with a master key and then re-lock the padlock in place after the inspection has been completed.

SUMMARY OF THE INVENTION

The present invention is directed to a padlock with a dual locking mechanism, which is enclosed in a locking body/housing. The dual locking padlock has a code locking mechanism operated by a combination code and an overriding mechanism activatable by a key. The housing has a spacer as its top portion, a stack of clutches forming a middle portion and a bottom portion having holes to receive screws from the spacer for securing the housing. Dials are rotatably mounted on the clutches for changing the combination code. The housing has a spindle having a channel to store the heel of a shackle. The spindle's upward movement allows the shackle to be pulled upward to unlock the padlock. The spindle is allowed to move upward either when a correct combination code is used or when a key activates the overriding mechanism. With the overriding mechanism, the user can open the padlock with a backup key if the user forgets the combination code, and then reset the dials to a new combination code.

Thus, one aspect of the present invention is a padlock operable in a locked mode and in an opened mode, comprising:

a shackle having a heel and a toe;

a lock housing configured to store the heel of the shackle, wherein the shackle can be partially released from the lock housing from a first shackle position to a second shackle position, the lock housing comprising a top portion, a stack of clutches forming a middle portion and a bottom portion, the middle portion having a substantially cylindrical exterior surface;

a plurality of dials movably mounted on the cylindrical exterior surface to form a combination code;

a spindle disposed inside the lock housing and arranged to provide a code locking mechanism, the code locking mechanism configured to keep the padlock in the locked mode based on the combination code; and an overriding mechanism disposed in relationship to the spindle, the overriding mechanism activatable to cause the padlock to operate in the opened mode, and wherein the shackle is in the first shackle position when the padlock is operated in the locked mode, and the shackle is in the second shackle position when the padlock is operated in the opened mode.

According to an embodiment of the present invention, the spindle comprises one or more slots, and the top portion of the lock housing comprises one or more holes to receive one or more fasteners, the fasteners arranged to pass through the slots on the spindle and to reach the bottom portion so as to secure the bottom portion to the top portion.

According to an embodiment of the present invention, the spindle comprises:

a channel to store the heel of the shackle; and a latch disposed in relationship to the channel, the latch having a fork arranged to engage the heel and the spindle so as to prevent the shackle from moving from the first shackle position to the second shackle position.

According to an embodiment of the present invention, the spindle is movably mounted on the bottom portion of the lock housing, and the spindle can be caused to move upward from the bottom portion in vertical movement to change from a first spindle position to a second spindle position, wherein the stack of clutches are arranged to control the vertical movement of the spindle, the clutches providing the cylindrical exterior surface, and wherein the dials are mounted over the cylindrical exterior surface in cooperation with the clutches such that when the combination code matches a predetermined code, the clutches allow the vertical movement of the spindle so that the shackle can be moved from the first shackle position to the second shackle position.

According to an embodiment of the present invention, the overriding mechanism can be activated by a key, causing the fork of the latch to disengage the heel of the shackle from the spindle so as to allow the shackle to move from the first shackle position to the second shackle position when the spindle is in the first spindle position.

According to an embodiment of the present invention, the stack of clutches include a first clutch and a last clutch, the last clutch arranged on top of the bottom portion of the lock housing, and wherein the top portion of the lock housing further comprises a spacer arranged on top of the first clutch and the spindle, wherein the spacer comprises:

a spacer hole in communication with the channel so as to allow placement of the heel of the shackle in the channel, and a cutout zone to allow the spindle to move from the first spindle position to the second spindle position.

According to an embodiment of the present invention, the top portion further comprises a top body having a plurality of extended clips, and the spacer comprises a plurality of locking channels, the locking channels arranged to receive the extended clips of the top body so as to secure the top body to the spacer.

According to an embodiment of the present invention, the top portion further comprises a top lid mounted on the top body, the top lid comprises a first hole in communication with the spacer hole, and a second hole arranged to receive the toe of the shackle when the shackle is in the first shackle position.

According to an embodiment of the present invention, the top lid further comprises:

a protrusion located in relationship to the second hole; and a plurality of lid clips located on peripheral surface of the top lid, and wherein the spacer further comprises a protrusion-receiving hole dimensioned to receive the protrusion of the top lid, and wherein the top body further comprises a plurality of clip-receiving slots arranged to receive the lid clips, such that when the shackle is in the first shackle position, the top lid and the top body are in a locked position.

According to an embodiment of the present invention, each of the clutches comprises an opening gap, and the spindle comprises a plurality of extended protrusions to align with the opening gaps of the clutches so as to allow the spindle to move from the first spindle position to the second spindle position.

According to an embodiment of the present invention, each of the clutches comprises a plurality of outer-teeth receiving slots and each of the dials comprises a plurality of teeth to engage with the outer-teeth receiving slots of a clutch to control rotational movement of said clutch.

According to an embodiment of the present invention, the heel of the shackle has an end portion with a larger diameter than remaining of the shackle and the channel of the spindle has a wider channel section than remaining of the channel, the wider channel section dimensioned to store the end portion of the heel, and wherein the fork of the latch is placed on top of the end portion of the heel in order to engage the heel and the spindle.

According to an embodiment of the present invention, the wider channel section of the channel has a section edge such that when the shackle is located in the second shackle position, the top of the end portion of the heel contacts the section edge of the wider channel section.

According to an embodiment of the present invention, the heel of the shackle has a shackle protrusion, and the spacer hole comprises a partial ring with a shackle-protrusion slot, the shackle-protrusion slot dimensioned to receive the shackle protrusion when the shackle is in the first shackle position, and when the shackle is in the second shackle position, the shackle protrusion moves upward and out of the shackle-protrusion slot, such that when the shackle is turned to move the shackle protrusion away from shack-protrusion slot, the shackle is prevented from moving downward.

According to an embodiment of the present invention, the top portion further comprises a top body mounted on the spacer, the top body comprising a first hole and a second hole, the first hole in communication with the spacer hole to allow placement of the heel of the shackle in the channel, and a second hole arranged to receive the toe of the shackle, and wherein the receiving hole of the spacer comprises a screw hole, and the second hole of the top body comprises a further hole to receive a fastener arranged to fasten into the screw hole of the spacer so as to secure the top body to the spacer.

According to an embodiment of the present invention, the top body can be removed from the spacer by removing the fastener from the screw hole when the shackle is in the second shackle position so as to allow a user to remove the dials from the cylindrical exterior surface to change the combination code.

According to an embodiment of the present invention, when the shackle is in the second shackle position, the top lid can be removed from the top body by disengaging the lid clips of the top lid from the clip-receiving slots of the top body, and the top body can be removed from the spacer by disengaging the extended clips of the top body from the locking channels of the spacer so as to allow a user to remove the dials from the cylindrical exterior surface to change the combination code.

According to an embodiment of the present invention, the heel of the shackle has an end portion and a neck portion having a smaller diameter than the end portion, wherein the fork of the latch is placed in the neck portion and on top of the end portion so as to engage the heel and the spindle.

According to an embodiment of the present invention, the dials can be removed from the cylindrical exterior surface when the shackle is in the second shackle position so as to allow a user to the change the combination code.

According to an embodiment of the present invention, the top portion comprise a top body with a toe hole to receive the toe of the shackle when the shackle is in the first shackle position, and the spindle comprises a plurality of extended protrusions, and each of the dials comprises a plurality of teeth, and wherein the stack of clutches are rotatably mounted on the lock housing to provide the cylindrical exterior surface, each of the clutches comprises:

an opening gap arranged to engage with an extended protrusion of the spindle, and a plurality of outer-teeth receiving slots arranged to engage with the teeth of a dial, and wherein the dials can be removed from cylindrical surface by aligning the opening gaps of the clutches with the extended protrusions of the spindle so as to allow the spindle to move upward when the shackle moves upward;

moving the shackle upward to change the shackle from the first shackle position to the second shackle position;

removing the top body from the top portion; and disengaging the teeth of the dials from the outer-teeth receiving slots of the clutches.

A feature of the present invention is a lost code defining system implemented in the padlock. In normal operations, a traveler is expected to use the combination feature of the lock and key operate mechanism allows the Transportation Security Administration (TSA) officer to inspect luggage if needed. If the traveler forgets the combination, the lost code defining system allows the user to open the padlock with a backup key and then reset the dials to a new combination.

Another feature of the present invention is that the dials are as big as the lock body which is advantageous for people with vision problems.

BRIEF DESCRIPTION OF THE DRAWINGS

For a fuller understanding of the nature and objects of the present invention, references are made to the detailed description taken in conjunction with the following drawings in which.

DETAILED DESCRIPTION (FIGS. 1-22)

The present invention is directed to a padlock with a dual locking mechanism: a code locking mechanism and an overriding mechanism. The padlock has a lock housing to store the heel of a shackle which is partially released when the padlock is changed from a locked mode to an opened mode. The padlock has a spindle in the lock housing to operate the code locking mechanism based on a combination code. The code locking mechanism can be overridden by a key operate mechanism. Both the code locking mechanism and the key overriding mechanism are disposed within the lock housing.

Figure 7:
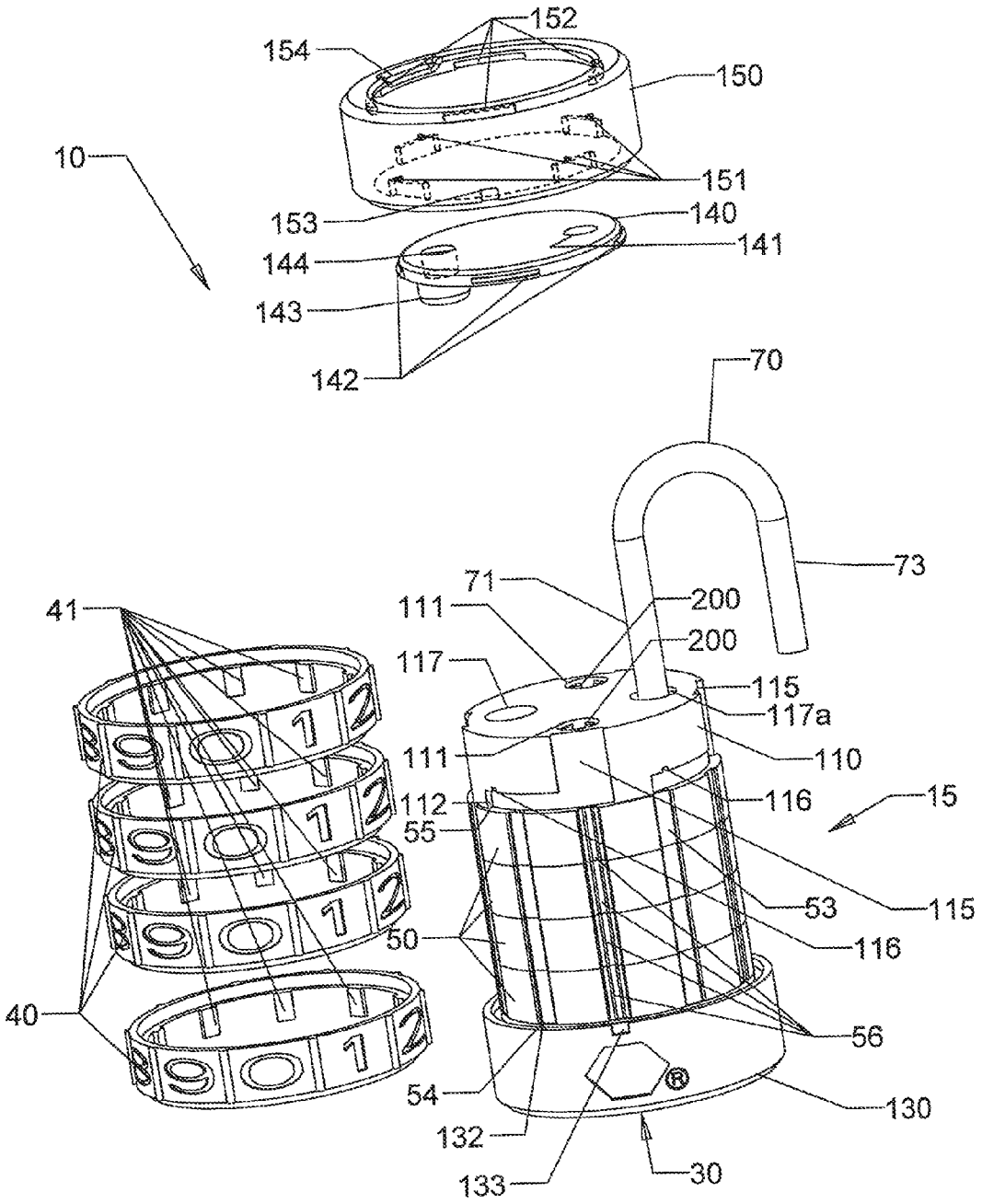
FIG. 7 is a perspective view of the padlock in the unlocked mode, with the dials and top lid removed from the lock housing.
Figure 8A:
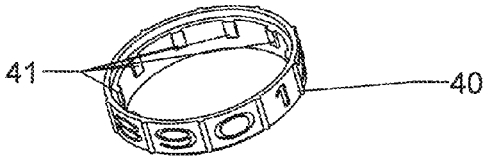
FIGS. 8A, 8B are perspective views of a dial.
Figure 8B:
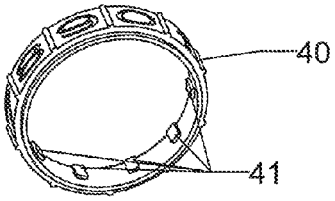
Figure 9A:
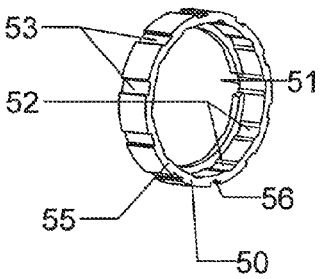
FIGS. 9A-9C are perspective views of a clutch.
Figure 9B:
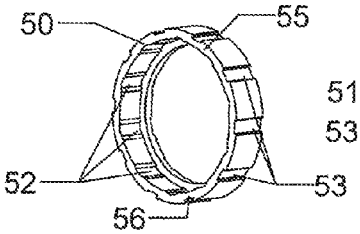
Figure 9C:
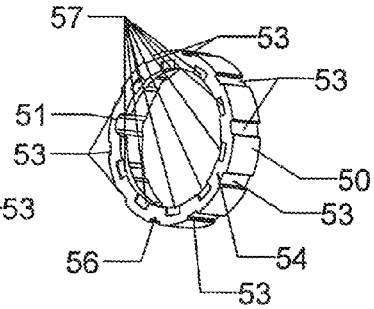
Figure 10A:
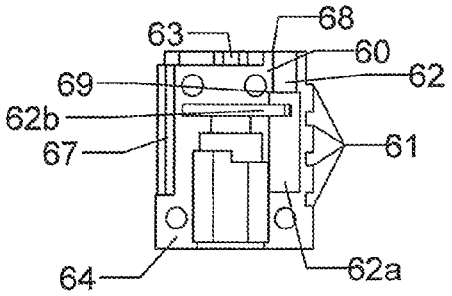
FIGS. 10A-10C are perspective views of part of the spindle of the padlock.
Figure 10B:
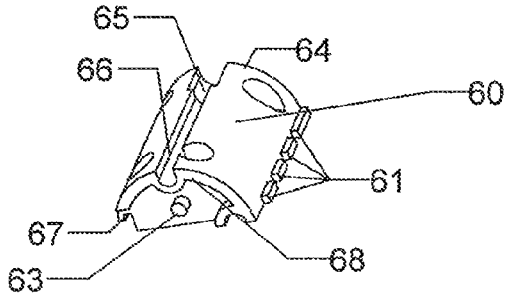
Figure 10C:
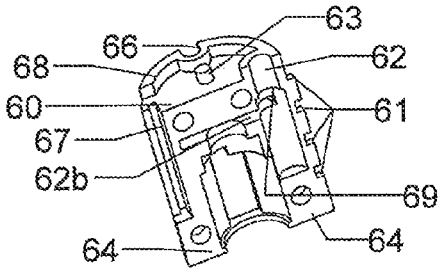
Figure 11:
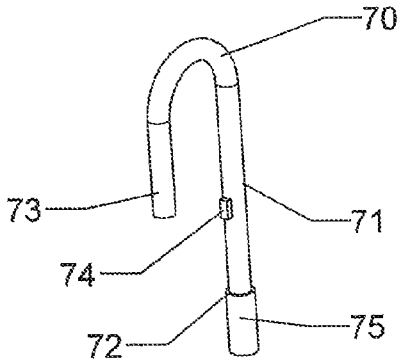
FIG. 11 is a perspective view of an embodiment of the shackle of the padlock, according to the present invention.
Figure 12:
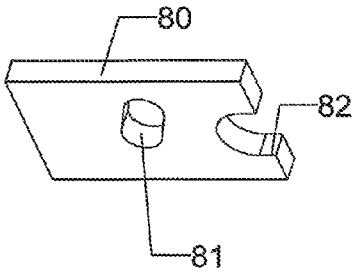
FIG. 12 is a perspective view of the latch of the padlock.
Figure 13:
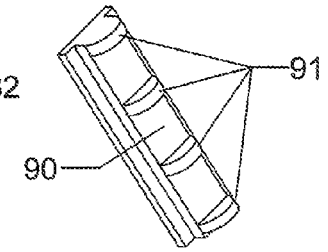
FIG. 13 is a perspective view of the ratchet plate of the padlock.
Figure 14:
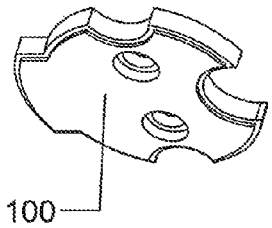
FIG. 14 is a perspective view of the cover plate of the padlock.
Figure 15A:
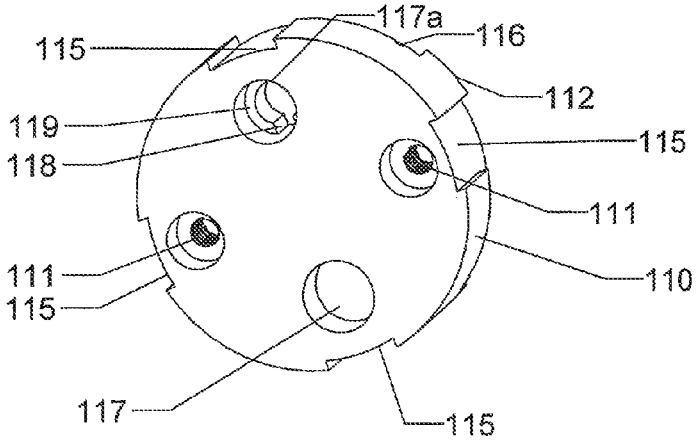
FIGS. 15A, 15B are perspective views of the spacer of the padlock.
Figure 15B:
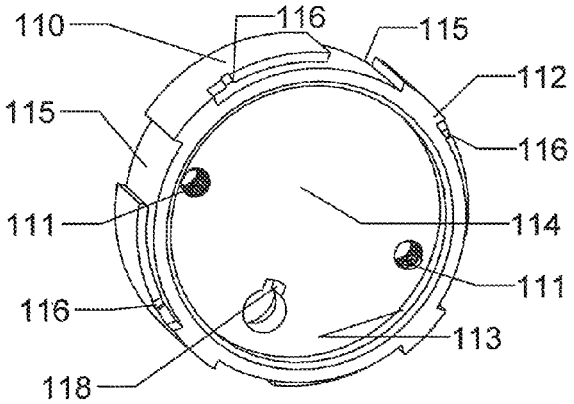
Figure 16:
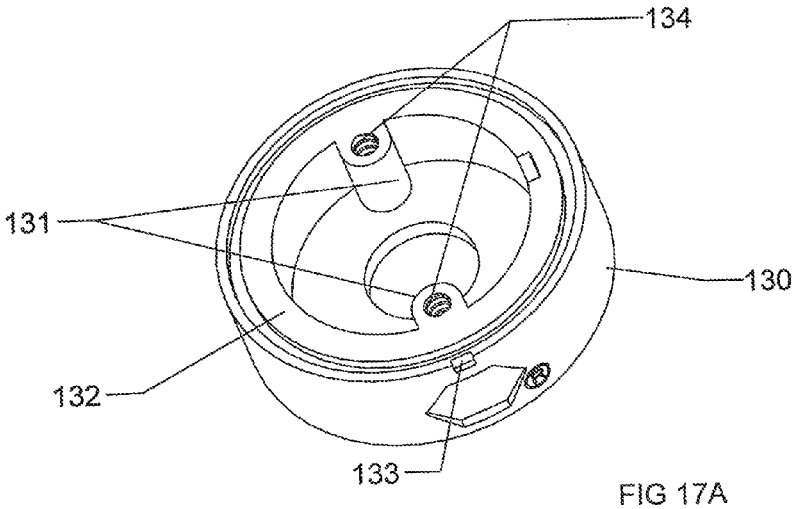
FIG. 16 is a perspective view of the bottom body of the padlock.
Figure 17A:
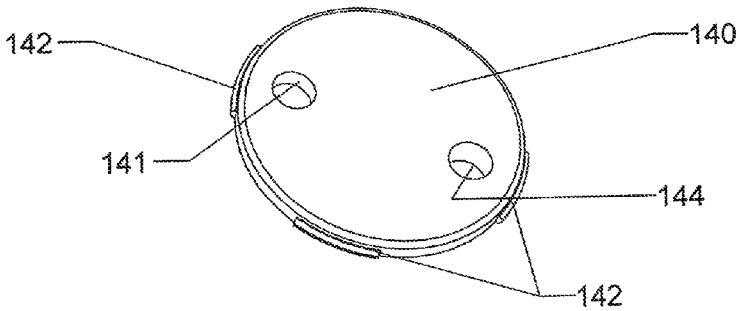
FIGS. 17A, 17B are perspective views of the top lid of the padlock.
Figure 17B:
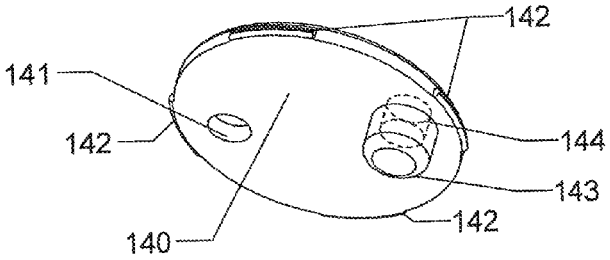
Figure 18A:
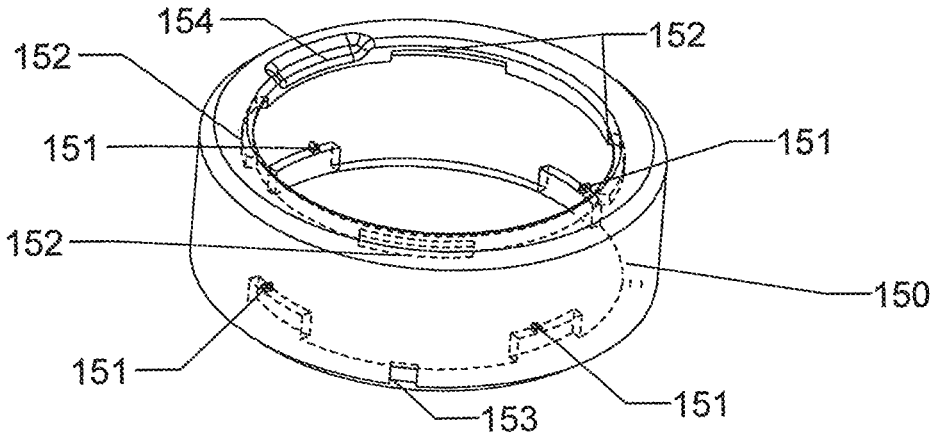
FIGS. 18A, 18B are perspective views of the top body of the padlock.
Figure 18B:
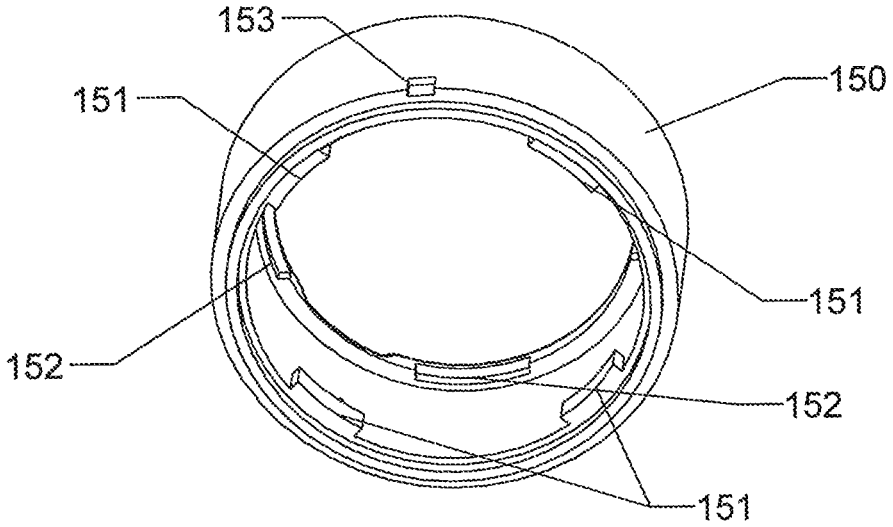
Figure 19:
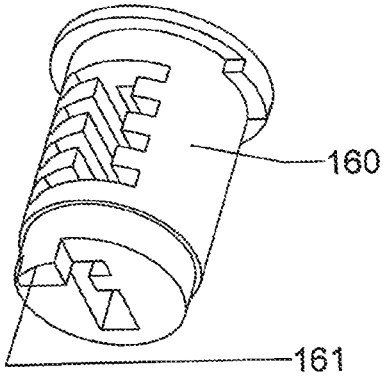
FIG. 19 is a perspective view of the cylinder of the padlock.
Figure 20:
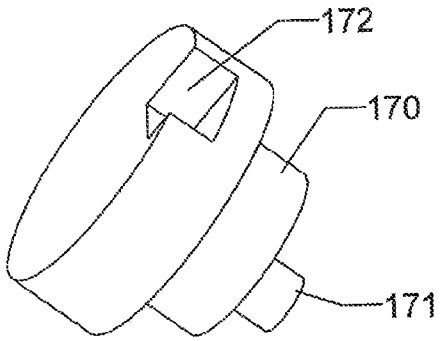
FIG. 20 is a perspective view of the cam of the padlock.

The padlock 10 has a bottom body 130, a plurality of clutches 50 arranged in a stack and mounted on top of the bottom body 130, and a spacer or top portion 110 mounted on top of the clutches 50 to form a lock housing 15 (see FIG. 7). The clutches 50 form a substantially cylindrical exterior surface of the lock housing 15. The padlock 10 also has a spindle 60 located within the lock housing 15. The spindle 60 has a channel 62 to store the heel 71 of the shackle 70, and is movably mounted on the bottom body 130 for vertical movement which is controlled by the clutches 50. The spacer 100 has a spacer hole 117*a* in communication with the channel 62 so as to allow the heel 71 to move upward and downward. The padlock 10 has a plurality of dials 40 to form a combination code 20. The dials 40 are rotatable mounted over the cylindrical exterior surface of the lock housing 15 so as to change the combination code. The dials 40 arranged to engage with the clutches 50 for moving the clutches 50 when dials 40 rotate. The heel 71 of the shackle 70 has an end portion 75 with a larger diameter than the remaining of the shackle 70, forming a step 72 between the smaller diameter and the larger diameter. The channel 62 has a wider channel section 62*a* than the remaining of the channel 62, and the wider channel section 62*a* has an upper edge 69. The wider channel section 62*a* is arranged to store the larger end portion 75 of the heel 71. The channel 62 also has a latch slot 62*b* for rotatably mounting a latch 80. One end of the latch slot 62*b* cuts into the wider channel section 62*a* of the channel 60 so as to place the fork 82 of the latch 80 on the heel 71 at the step 72 above the larger end portion 75. As such, when the padlock 10 is in the locked mode or opened by the combination code, the latch 80 always engages the heel 71 of the shackle 70 and the spindle 60, so that all pulling or pushing of the shackle 70 will directly transfer to the spindle 60. The spindle 60 has a row of extended protrusions 61, and each of the clutches 50 has an opening-gap 51 on the interior clutch surface to receive an extended protrusion 61. Thus, the spindle 60, along with the clutches 50 and the latch 80, provides the code locking mechanism based on the combination code. The code locking mechanism is controlled by dials 40 such that when all of the dials 40 are turned to the preset lock-opened combination, the opening-gap 51 of each of clutches 50 will align with the corresponding extended protrusion 61 of the spindle 60. This allows the user to pull the shackle 70 upward along with the spindle 60. As the shackle 70 is pulled upward, the shackle 70 can swing freely while part of the heel 71 remains in the channel 62 of the spindle 60.

In an embodiment of the present invention, a clutch 50 has one or more faulty notches 57. A faulty notch 57 allows an extended protrusion of the spindle 60 to contact such that it makes the padlock harder to pick.

Locked Mode and Lock Construction (FIG. 1, 2, 3, 8*a*-20):

The spindle 60 has two bodies screwed together or mated together with rivets to form a single piece. The spindle 60 has two straight slots 66 along the spindle surface. The bottom end 64 of the spindle 60 has two curved slots 65 extended from the straight slots 66. Each of curved slots 65 is dimensioned to receive a curved-receiving-slot 131 of the bottom body 130. With the curved-receiving-slots 131 being placed in the curved slots 65, the spindle 60 has no rotational movement relative to the bottom body 130, which limits the spindle 60 to only have vertical movement. The spindle 60 has a ratchet slot 67 to receive a ratchet plate 90 with a row of ratchet tips 91. Each of the clutches 50 has a number of ratchet-receiving slots 52 on its interior surface. The ratchet-receiving slot 52 is dimensioned to receive a ratchet tip 91 of the ratchet plate 90 so that rotational movement of the clutch 50 relative to the spindle 60 will provide a ratchet (clicking) feeling. The spindle 60 also has a covering plate 100 attached to the top 68 of the spindle 60 with rivet 63 for permanently securing the ratchet plate 90 to the spindle 60. After the spindle 60 is placed inside the stack of clutches 50, a spacer 110 is placed on top of the clutches 50 and the spindle 60. The spacer 110 has one or more screws/rivet holes 111 to allow one or more screws 200 (or rivets) to pass through the straight slots 66 on the spindle 60 and to screw into one or more screw holes 134 of the bottom body 130. After the screws 200 or rivets are fastened, the clutches 50 can rotate in a horizontal direction but cannot move vertically. The clutches 50 cannot move upward because of the top surface 55 of the top clutch 50 is in contact to the flat surface 112 of the spacer 110. The clutches 50 cannot move downward because the bottom surface 54 of the last clutch 50 is in contact to the flat surface 132 of the bottom body 130. The spacer 110, the clutches 50 and the bottom body 130 form a lock housing 15 of the padlock 10. The stack of clutches 50 provides a cylindrical surface on the lock housing 15 for mounting the dials 40. The spacer 110 has a cutout zone 113 to allow the spindle 60 to move upward from the bottom body 130 in a vertical movement only when all of the opening-gaps 51 of clutches 50 align with the extended-protrusions 61 of the spindle 60.

To complete the assembling of the padlock 10, the dials 40 are mounted over the clutches 50 according to the preset combination code 20. Each of the clutches 50 has a number of teeth-receiving slots 53 on its exterior surface. Each of the dials 40 has a matching number of teeth 41 on its interior surface. The teeth 41 of a dial 40 are arranged to be inserted into the teeth-receiving slots 53 of a clutch 50. As such, the rotational movement of a dial 40 will be transferred to a clutch 50. As one or more dials 40 are turned, the user can get a ratchet feeling. After the mounting of dials 40, a top body 150 is placed on top of the spacer 110 and then a top lid 140 is engaged with the top body 150. The top body 150 has a number of extended clips 151 on its interior surface. The spacer 110 has a matching number of channels 115, each of which is extended into a resting area 116. When the top body 150 is placed on top of the spacer 110, the extended clips 151 on the top body 150 are pushed through the channel 115 of the spacer 110 and then the top body 150 is turned until the extended clips 151 are engaged in the resting areas 116. Thus, the channel 115 and the resting area 116 together function like a locking channel. Through the heel hole 141, the top lid 140 is guided through the short-leg toe 73 and part of the long-leg heel 71 until the protrusion 143 under the locking hole 144 is placed in a receiving hole 117 on top of the spacer 110. The top lid 140 has a number of extended clips 142 arranged to engage with the clip-receiving slots 152 of the top body 150. Once the toe 73 of the shackle 70 is placed in the locking hole 144 of the top lid 140 as the shackle 70 is pushed downward, the shackle 70, the top lid 140 and the top body 150 are locked in place. The dials 40 cannot be removed from the lock housing 15.

One or more of the dials 40 can be rotated in order to cause misalignment between at least one opening-gap 51 of the clutch 50 and one extended-protrusion 61 of the spindle 60. The misalignment prevents the spindle 60 from be pulled upward. Because the shackle 70 is engaged with the spindle 60 by latch 80 at the step 72, the shackle 70 cannot be pulled upward. Thus, the toe 73 of the shackle 70 is locked in the locking hole 144 of the top lid 140. In order to unlock the padlock, the user must use the correct combination code or use the key overriding mechanism.

The key overriding mechanism 30 is located inside the spindle 60 in relationship to the wider channel section 62*a* of the channel 60. The key overriding mechanism 30 has a cylinder 160 and a cam 170 placed on top to the cylinder 160. The cylinder 160 has a plurality of wafers 180 on part of its cylindrical body. The cylinder 160 has an extended protrusion 161 on its top end. The cam 170 has a cam hole 172 dimensioned to receive the extended protrusion 161 of the cylinder 160. On top of the cam 170 there is an extended pin 171 arranged to engage with a slot 81 of the latch 80. When the padlock 10 is in the locked mode, the fork 82 of the latch 80 engages the heel 71 of the shackle 70 and the spindle 60. The wafers 180 and the associated pins prevent the cylinder 160 from turning unless a backup key is used. As the cylinder 160 does not turn, the cam 170 cannot turn and the latch 80 is in a locked position. As such, the fork 82 of the latch 80 restricts the end portion 75 of the heel 71 from moving upward so as to release the toe 73 from the locking hole 144 of the top lid 140. In this situation, the shackle 70 is said to be in a sandwiched-locked position.

Unlock by Combination Code (FIGS. 5*a*, 5*b*, 6 and 7):

To unlock the padlock 10 by the combination code, the user must align the combination code 20 formed by the dials 40 with the indicating line 153/133 on the top body 150 and bottom body 130. The user must also perform the following steps:

A) Disengaging the Toe from Locking Hole

As the combination code 20 is aligned, the indicating mark 56 of the clutch 50 is also aligned in the same manner. The opening-gap 51 of each clutch 50 now aligns with an extended-protrusion 61 of the spindle 60. The user can now pull the shackle 70 upward along with the spindle 60 since the shackle 70 is in the sandwiched-locked position. As the shackle 70 is pulled upward, the toe 73 of the shackle 70 is disengaged from the locking hole 144 of the top lid 140.

B) Rotating the Shackle

As the shackle 70 moves upward, the shackle 70 pulls the spindle 60 upward until the top 68 of the spindle 60 hits the edge 114 of the spacer 100. As can be seen from 15A, the spacer hole 117*a* has a partial ring 119 with a shackle-protrusion slot 118. The shackle-protrusion slot 118 is dimensioned to receive the shackle protrusion 74. As the shackle 70 moves upward, the shackle protrusion 74 of the shackle 70 moves out of the shackle-protrusion slot 118 and rests on the surface of partial ring 119 of the spacer 110. When the shackle 70 is released, the user can rotate the shackle 70. As the shackle 70 rotates, the shackle protrusion 74 of the shackle 70 remains on the surface of the partial ring 119. This prevents the shackle 70 from moving downward. This is important because after the shackle 70 is pulled upward and prevented from falling back, the protrusion 61 of the spindle 60 will always engage with the opening-gap 51 of the clutch 50 in the alignment. As such, the clutches 50 are prevented from having any rotational movement while the padlock 10 is in the opened mode, unlocked by the combination code.

Unlock by Key Mechanism Mode (FIG. 4):

The key overriding mechanism 30 is controlled by the cylinder 160 which is a wafer tumbler cylinder. The user can use a backup key to unlock the padlock 10.

C) Disengaging the Shackle from the Latch

The user can insert a correct key 190 into the key overriding mechanism 30 and turn the cylinder 160. Because the extended protrusion 161 of the cylinder 160 is engaged with the hole 172 of the cam 170, the cam 170 is also turned along with the cylinder 160. Furthermore, the extended pin 171 of the cam 170 is engaged with the slot 81 of the latch 80. The rotational movement of the cylinder 160 is transferred into a horizontal movement of the latch 80 by the cam 170. The horizontal movement of the latch 80 causes the fork 82 of the latch 80 to move away from the channel 62 of the spindle 60, allowing the end portion 75 of the heel 71 to move upward relative to the spindle 60 until the end portion 75 hits the upper edge 69 of the wider channel section 62*a* of the channel 62. As such, the shackle protrusion 74 of the shackle 70 moves out of the shackle-protrusion-slot 118 of the spacer 110 and the toe 73 is disengaged from the locking hole 144 of the top lid 140. Now the shackle 70 can swing freely.

It should be noted that, because the opening gaps 51 of the clutches 50 are not totally aligned with extended protrusions 61 of the spindle 60, the spindle 60 has no vertical movement. It should also be noted that, the key 190 can be a backup key specifically cut for a certain key overriding mechanism 30 or a master key. The backup key is provided to the user of the padlock 10 and the master key is provided to security personnel or to the Transportation Security Administration (TSA).

Figure 4:
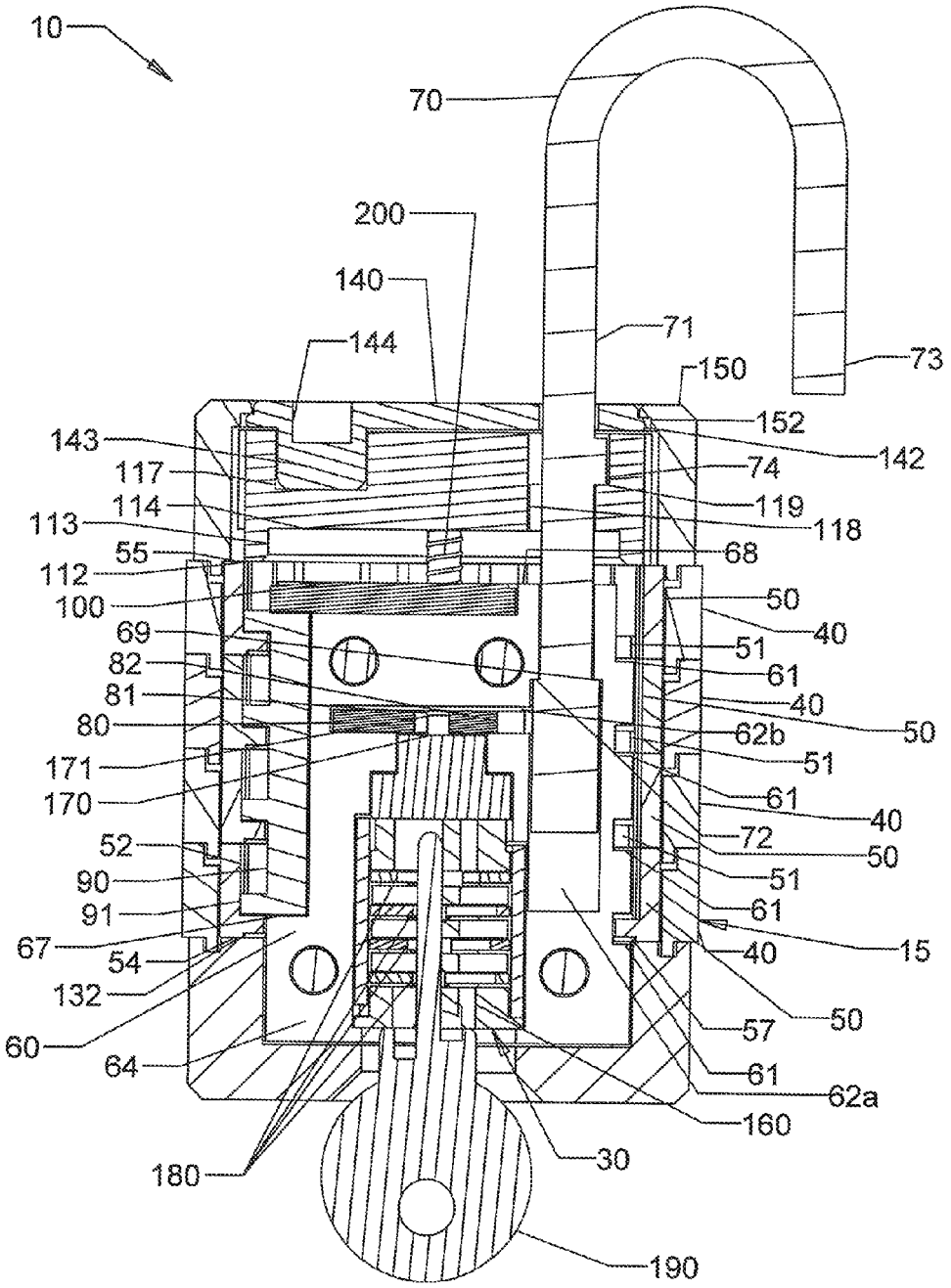
FIG. 4 is a cross-sectional view of the padlock shown in FIG. 1 in the unlocked mode with a key unlocking the padlock.
Figure 5A:
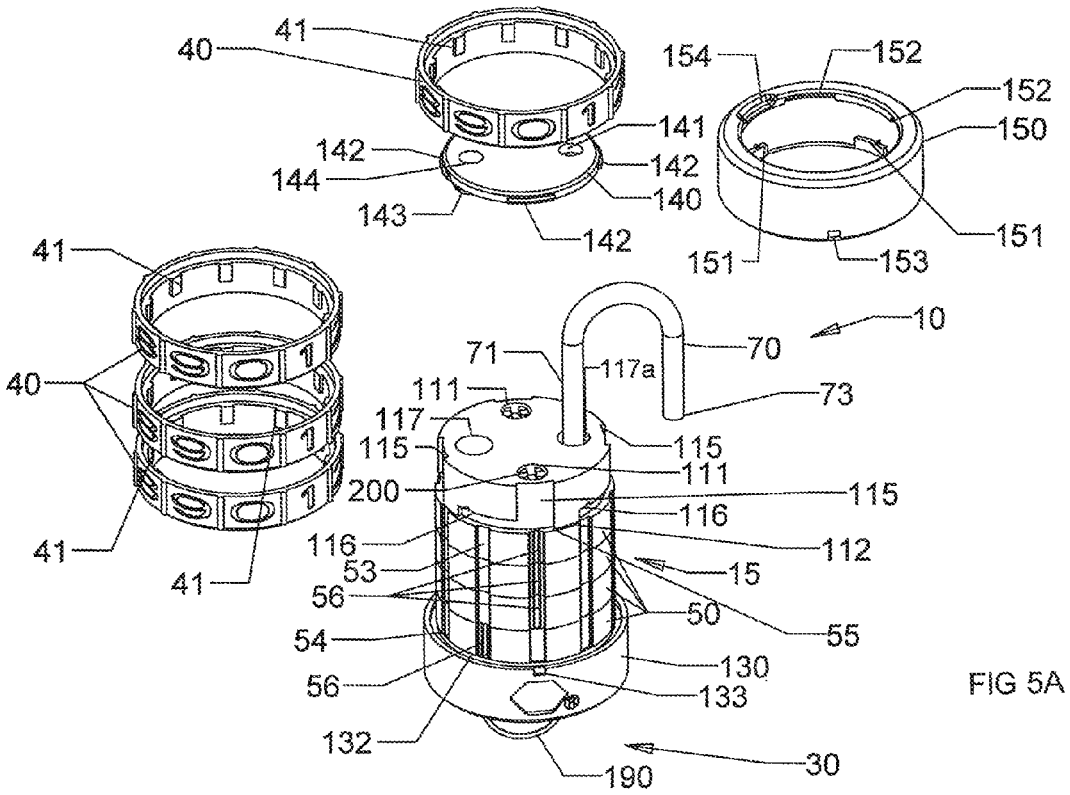
FIGS. 5A, 5B are exploded perspective views of parts forming the padlock.
Figure 5B:
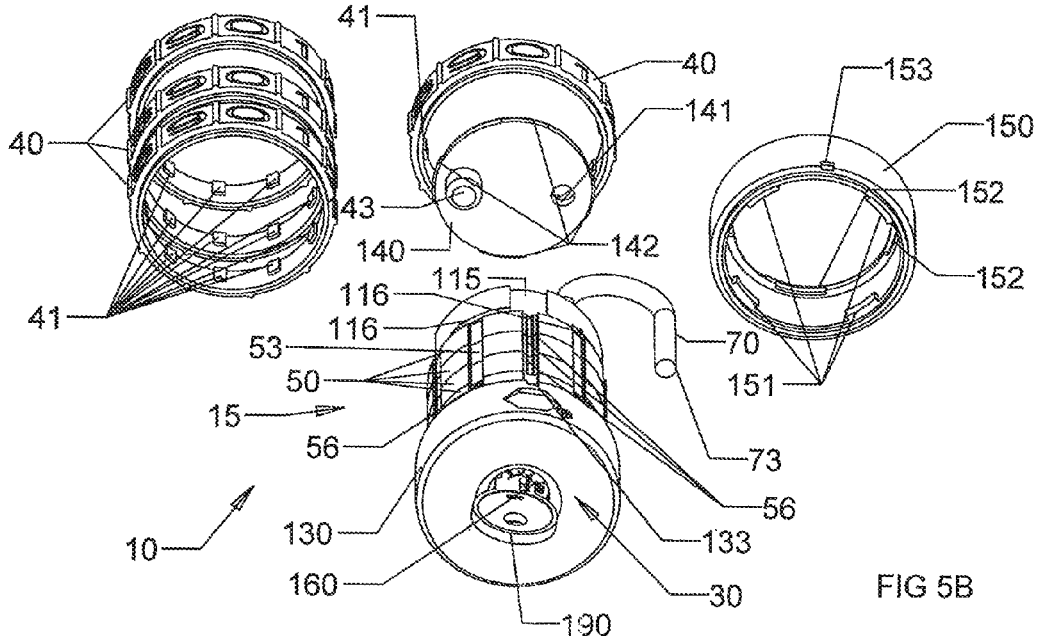
Figure 6:
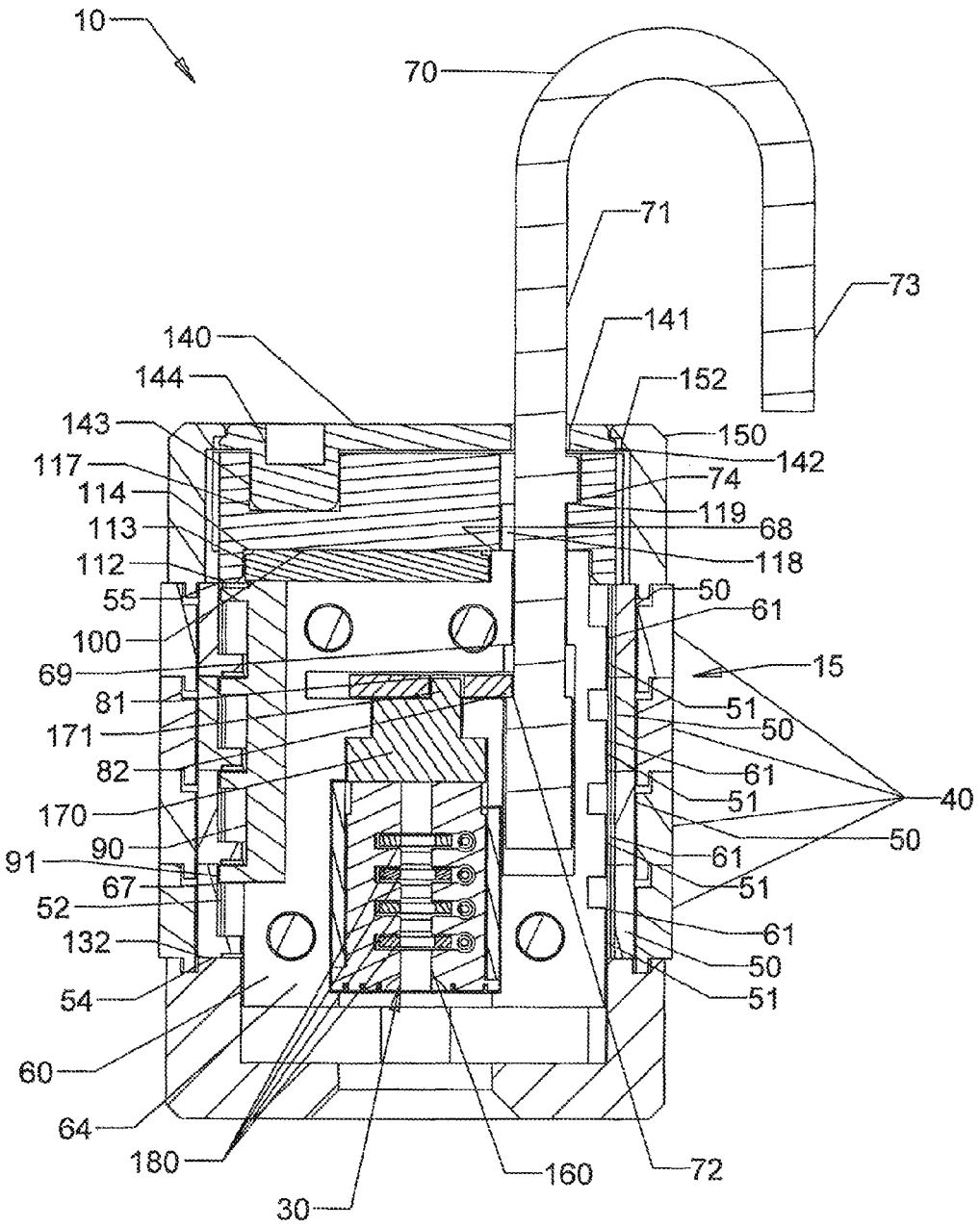
FIG. 6 is a cross-sectional view of the padlock shown in FIG. 1 in the unlocked mode with a combination code unlocking the padlock.

Lost Code Defining Mechanism (FIG. 4 and FIG. 5*a*-5*b*)

If the user loses or forgets the combination, the user can now open the lock using the backup key 190 as described above. As the toe 73 of the shackle 70 is no longer in the locking hole 144, the top lid 140 can be pulled away from the top body 150 using a gap 154 provided on the top body 150, for example. The user may also remove the top lid 140 from the shackle 70.

D) Removing the Top Body

As the top lid 140 is removed from the top body 150, the top body 150 can be rotated counterclockwise (relative to FIG. 4) to release the extended-clip 151 of the top body 150 from the resting-area 116 of the spacer 110. The top body 150 can then be pulled upward and away from the rest of the padlock 10.

E) Aligning the Clutches

The user can now move all of the dials 40 out of the lock housing 15 and then rotate the clutches 50 so that the indicating mark 56 on each of the clutches 50 is aligned with the indicating line 133 on the bottom body 130. The clutches 50 are now positioned such that the opening-gap 51 of each of the clutches 50 aligns with an extended-protrusion 61 of the spindle 60.

F) Reassembling the Dials

After the alignment of the clutches 50, the user can put the dials 40 back onto the clutches 50 with a desired combination. Without disturbing the clutches 50, the user can place the dials 40 on the clutches 50 such that each of the numbers forming the desired combination aligns with the indicating line 133 of the bottom body 130.

G) Reassembling the Top Body and Top Lid

After the placement of the dials 40, the user can put back the top body 150 by pushing the extended-clips 151 of the top body 150 through the channels 115 of the spacer 110 and then turn the top body 150 until the extended-clips 151 are located in the resting-area 116 of the spacer 110. The user can then place the top lid 140 back by aligning the protrusions 143 of the top lid to the holes 117 of the spacer 110. The user can now rotate the shackle 70 and lock the toe 73 in the locking hole 144 of the top lid 140.

After withdrawing the key 190 out of the cylinder 160 and scrambling the combination, the user can use the new combination code to open the lock again.

Reset by Combination (FIGS. 6 and 7):

To reset the combination, the user must open the padlock 10 by using the combination code 20 and aligning the dials 40 to the indicating line 153/133 on the top body 150 and bottom body 130. The user may follow Step (A) to disengage the toe 73 of the shackle 70 from the locking hole 144 of the top lid 140. The user may then follow Step (B) to move the shackle 70 out of the way. Now the user can remove the top lid 140 so that the protrusion 143 is disengaged from the hole 117 of the spacer 110. The top lid 140 can now be slid along the shackle 70 and removed from the rest of the padlock 10. The user may follow Step (D) to remove the top body 150. The user can move all of the dials 40 out of the clutches 50 and then put back the dials 40 onto the clutches 50 with the user's own desired combination. Without disturbing the clutches, the user places the dials onto the clutches such that each of the numbers forming the desired combination aligns with the indicating line 133 on the bottom body 130. The user may then re-assemble the top body 150 and the top lid 140 by following Step (G) above.

Figure 21:
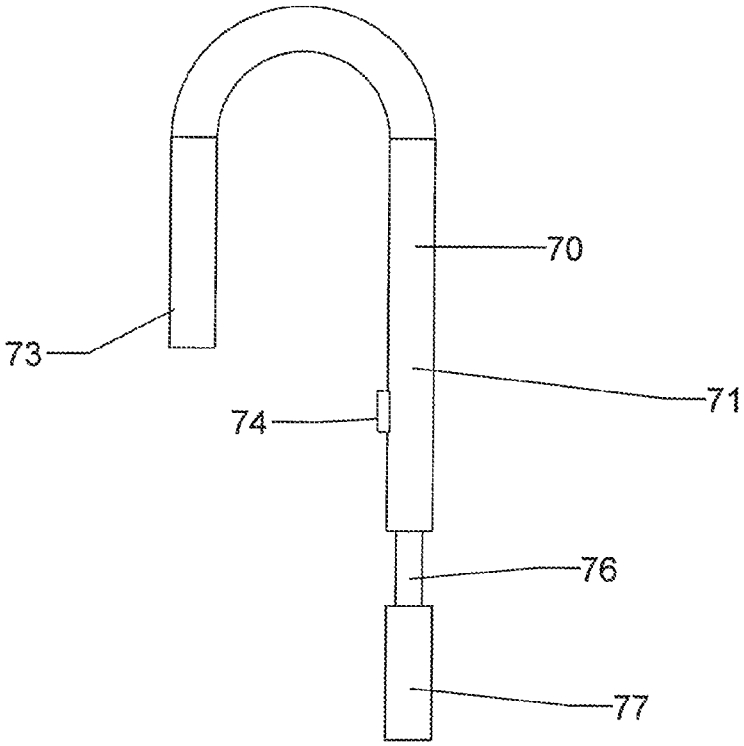
FIG. 21 is a side view of another embodiment of the shackle of the padlock, according to the present invention.

Another Embodiment of Shackle (FIG. 21)

As shown in FIG. 21, the shackle 70 has a toe 73 and a heel 71 with a shackle protrusion 74. Instead of having an end portion with a larger diameter (see FIG. 11), the heel 71 has an end portion 77 after a narrower neck 76. With this embodiment, the fork 82 of the latch 80 (see FIG. 12) will engage with the neck 76 when the padlock 10 is in the locked mode. The shackle 70 can move vertically upward when the fork 82 is moved away from the channel 62 of the spindle 60 which is similar to the situation when the padlock is the unlocked by the key overriding mechanism as described above.

Figure 22:
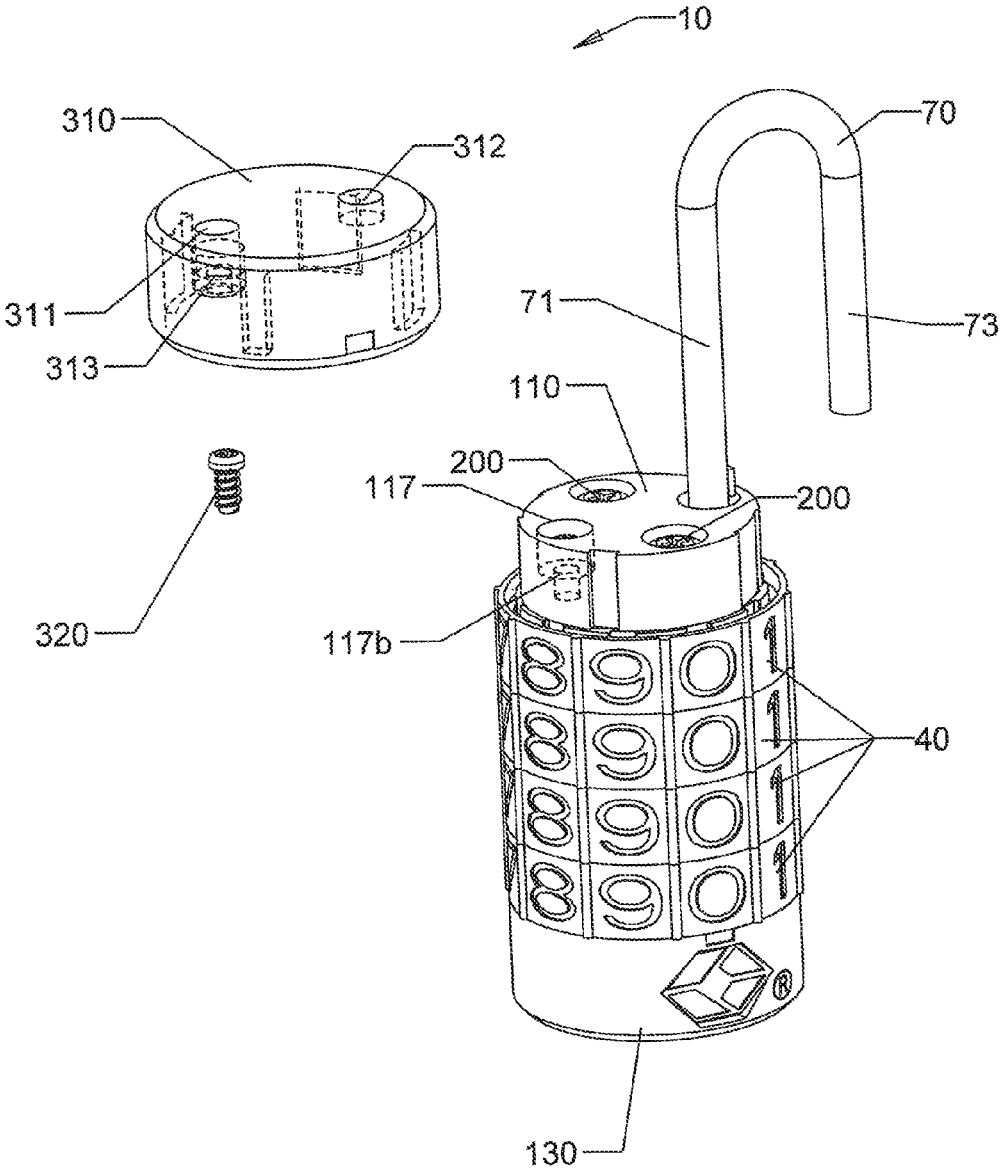
FIG. 22 is a perspective view of another embodiment of a padlock according to the present invention, with a top body being separated from the rest of the padlock.

Integrated Dual Locking with Lost Code Define System (FIG. 22)

In one embodiment of the present invention, the top lid 140 and top body 150 (see FIG. 2, for example) are integrated into a one-piece top body 310. The one-piece top body 310 has a toe hole 311 to receive the toe 73 of the shackle 70, and a heel hole 312 in communication with the spacer hole 117*a* to allow placement of the heel 71 in the channel 62. The shackle one-piece top body 310 further comprises a screw hole 313 inside the toe hole 311. The screw hole 313 allows a screw 320 to fasten onto the screw hole 117*b* of the spacer 110.

Figure 1:
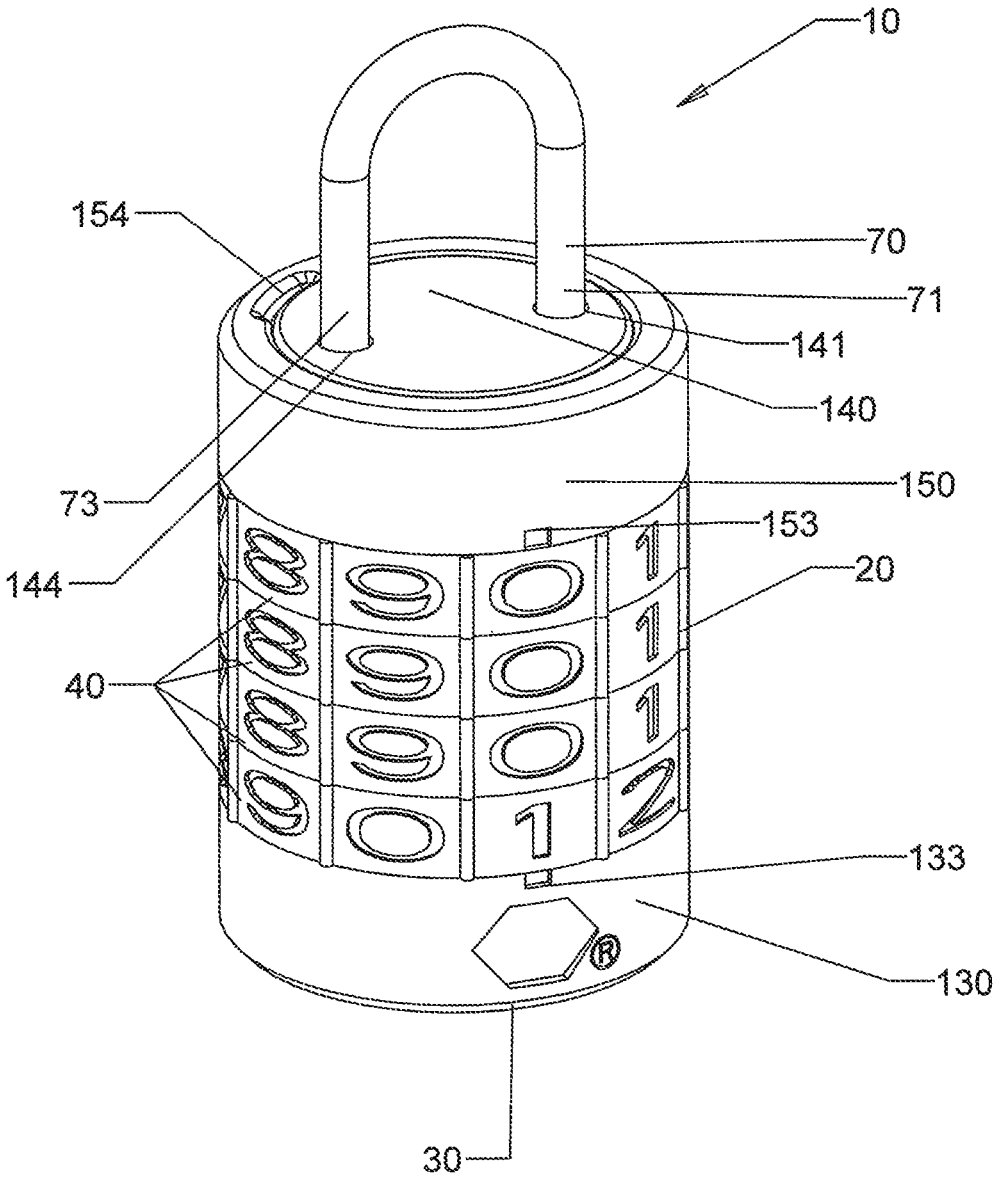
FIG. 1 is a perspective view of an exemplary embodiment of a padlock according to the present invention.
Figure 2:
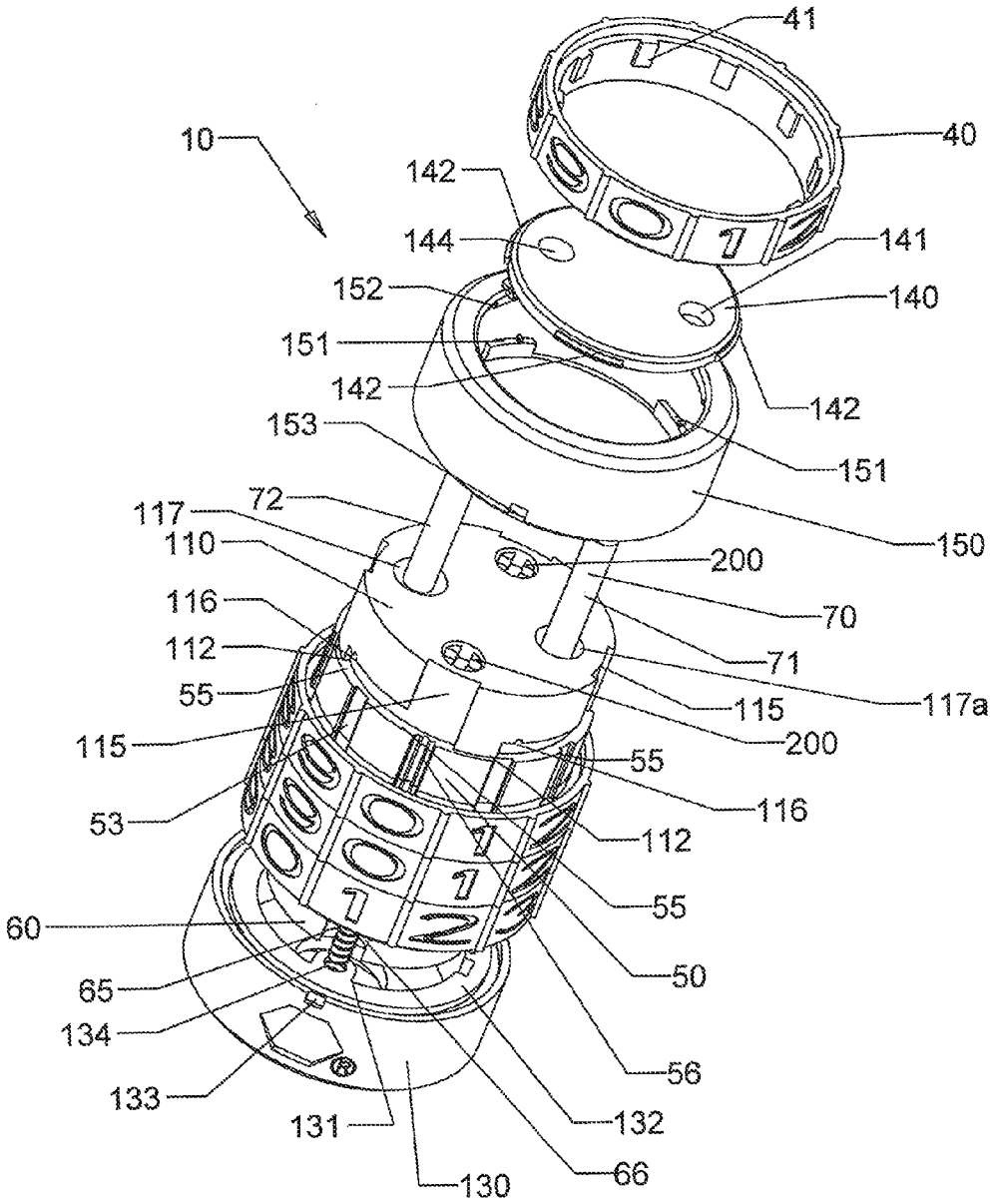
FIG. 2 is an exploded perspective view of the padlock.
Figure 3:
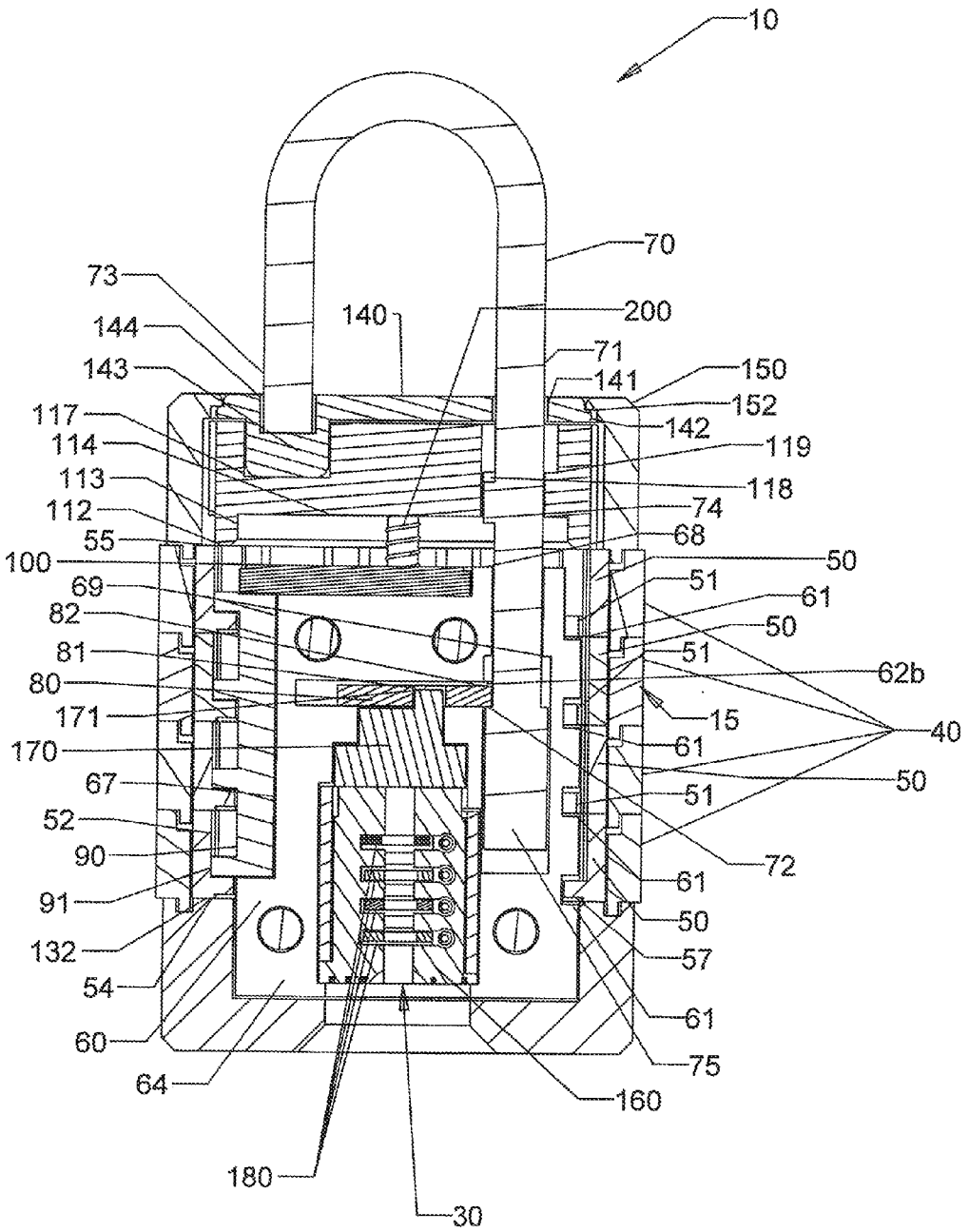
FIG. 3 is a cross-sectional view of the padlock shown in FIG. 1 with the shackle in the locked mode.

After the one-piece top body 310 is mounted on top of the spacer 110, the screw 320 can be fastened into the screw hole 313 of the one-piece top body 310 and the screw hole 117*b* of the spacer 110. When the padlock is in the locked mode, the one-piece top body 310 cannot be removed from the rest of the padlock. With the one-piece top body 310, the reset function is simpler to operate than the embodiment as shown in FIG. 1. In the reset mode, the user can simply pull the shackle 70 upward and swing the shackle 70 away from the toe hole 311 and remove the screw 320 away from the screw hole 117*b* of the spacer 110 and the screw hole 313 of the one-piece top body 310. The user can then remove the one-piece top body 310 away from the spacer 110 and slot out the dials 40. After re-assembly the dials 40 with a desired combination, the user can put the one-piece top body 310 back on the spacer 110 and fasten the screw 320 in place.

Thus, although the present invention has been described with respect to one or more embodiments thereof, it will be understood by those skilled in the art that the foregoing and various other changes, omissions and deviations in the form and detail thereof may be made without departing from the scope of this invention.

What is claimed is:

1. A padlock operable in a locked mode and in an opened mode, comprising:

a shackle having a heel and a toe;

a stack of clutches;

a plurality of dials, each dial having a substantially cylindrical outer surface;

a lock housing configured to store the heel of the shackle, wherein the shackle can be partially released from the lock housing from a first shackle position to a second shackle position, the lock housing comprising a top portion, a bottom portion, and a middle portion having a substantially cylindrical exterior surface formed by the stack of clutches, the plurality of dials movably mounted on the cylindrical exterior surface of the middle portion of the lock housing so as to expose an entirety of the cylindrical outer surface of each of the plurality of dials for forming a combination code;

a spindle disposed inside the lock housing and arranged to provide a code locking mechanism, the code locking mechanism configured to keep the padlock in the locked mode based on the combination code; and an overriding mechanism disposed in relationship to the spindle, the overriding mechanism activatable to cause the padlock to operate in the opened mode, and wherein the shackle is in the first shackle position when the padlock is operated in the locked mode, and the shackle is in the second shackle position when the padlock is operated in the opened mode.

2. The padlock according to claim 1, wherein the spindle comprises one or more slots, and the top portion of the lock housing comprises one or more holes to receive one or more fasteners, the fasteners arranged to pass through the slots on the spindle and to reach the bottom portion so as to secure the bottom portion to the top portion.

3. The padlock according to claim 1, wherein the spindle comprises:

a channel to store the heel of the shackle; and a latch disposed in relationship to the channel, the latch having a fork arranged to engage the heel and the spindle so as to prevent the shackle from moving from the first shackle position to the second shackle position.

4. The padlock according to claim 3, wherein the spindle is movably mounted on the bottom portion of the lock housing, and the spindle can be caused to move upward from the bottom portion in vertical movement to change from a first spindle position to a second spindle position, wherein the stack of clutches are arranged to control the vertical movement of the spindle, the clutches providing the cylindrical exterior surface, and wherein the dials are mounted over the cylindrical exterior surface in cooperation with the clutches such that when the combination code matches a predetermined code, the clutches allow the vertical movement of the spindle so that the shackle can be moved from the first shackle position to the second shackle position.

5. The padlock according to claim 3, wherein the overriding mechanism can be activated by a key, causing the fork of the latch to disengage the heel of the shackle from the spindle so as to allow the shackle to move from the first shackle position to the second shackle position when the spindle is in the first spindle position.

6. The padlock according to claim 4, wherein the stack of clutches include a first clutch and a last clutch, the last clutch arranged on top of the bottom portion of the lock housing, and wherein the top portion of the lock housing further comprises a spacer arranged on top of the first clutch and the spindle, wherein the spacer comprises:

a spacer hole in communication with the channel so as to allow placement of the heel of the shackle in the channel, and a cutout zone to allow the spindle to move from the first spindle position to the second spindle position.

7. The padlock according to claim 6, wherein the top portion further comprises a top body having a plurality of extended clips, and the spacer comprises a plurality of locking channels, the locking channels arranged to receive the extended clips of the top body so as to secure the top body to the spacer.

8. The padlock according to claim 7, wherein the top portion further comprises a top lid mounted on the top body, the top lid comprises a first hole in communication with the spacer hole, and a second hole arranged to receive the toe of the shackle when the shackle is in the first shackle position.

9. The padlock according to claim 8, wherein the top lid further comprises:

a protrusion located in relationship to the second hole; and a plurality of lid clips located on peripheral surface of the top lid, and wherein the spacer further comprises a protrusion-receiving hole dimensioned to receive the protrusion of the top lid, and wherein the top body further comprises a plurality of clip-receiving slots arranged to receive the lid clips, such that when the shackle is in the first shackle position, the top lid and the top body are in a locked position.

10. The padlock according to claim 4, wherein each of the clutches comprises an opening gap, and the spindle comprises a plurality of extended protrusions to align with the opening gaps of the clutches so as to allow the spindle to move from the first spindle position to the second spindle position.

11. The padlock according to claim 10, wherein each of the clutches comprises a plurality of outer-teeth receiving slots and each of the dials comprises a plurality of teeth to engage with the outer-teeth receiving slots of a clutch to control rotational movement of said clutch.

12. The padlock according to claim 5, wherein the heel of the shackle has an end portion with a larger diameter than remaining of the shackle and the channel of the spindle has a wider channel section than remaining of the channel, the wider channel section dimensioned to store the end portion of the heel, and wherein the fork of the latch is placed on top of the end portion of the heel in order to engage the heel and the spindle.

13. The padlock according to claim 12, wherein the wider channel section of the channel has a section edge such that when the shackle is located in the second shackle position, the top of the end portion of the heel contacts the section edge of the wider channel section.

14. The padlock according to claim 6, wherein the heel of the shackle has a shackle protrusion, and the spacer hole comprises a partial ring with a shackle-protrusion slot, the shackle-protrusion slot dimensioned to receive the shackle protrusion when the shackle is in the first shackle position, and when the shackle is in the second shackle position, the shackle protrusion moves upward and out of the shackle-protrusion slot, such that when the shackle is turned to move the shackle protrusion away from shack-protrusion slot, the shackle is prevented from moving downward.

15. The padlock according to claim 6, wherein the top portion further comprises a top body mounted on the spacer, the top body comprising a first hole and a second hole, the first hole in communication with the spacer hole to allow placement of the heel of the shackle in the channel, and a second hole arranged to receive the toe of the shackle, and wherein the receiving hole of the spacer comprises a screw hole, and the second hole of the top body comprises a further hole to receive a fastener arranged to fasten into the screw hole of the spacer so as to secure the top body to the spacer.

16. The padlock according to claim 15, wherein the top body can be removed from the spacer by removing the fastener from the screw hole when the shackle is in the second shackle position so as to allow a user to remove the dials from the cylindrical exterior surface to change the combination code.

17. The padlock according to claim 9, wherein, when the shackle is in the second shackle position, the top lid can be removed from the top body by disengaging the lid clips of the top lid from the clip-receiving slots of the top body, and the top body can be removed from the spacer by disengaging the extended clips of the top body from the locking channels of the spacer so as to allow a user to remove the dials from the cylindrical exterior surface to change the combination code.

18. The padlock according to claim 5, wherein the heel of the shackle has an end portion and a neck portion having a smaller diameter than the end portion, wherein the fork of the latch is placed in the neck portion and on top of the end portion so as to engage the heel and the spindle.

19. The padlock according to claim 1, wherein the dials can be removed from the cylindrical exterior surface when the shackle is in the second shackle position so as to allow a user to the change the combination code.

20. The padlock according to claim 19, wherein the top portion comprise a top body with a toe hole to receive the toe of the shackle when the shackle is in the first shackle position, and the spindle comprises a plurality of extended protrusions, and each of the dials comprises a plurality of teeth, and wherein the stack of clutches are rotatably mounted on the lock housing to provide the cylindrical exterior surface, each of the clutches comprises:

an opening gap arranged to engage with an extended protrusion of the spindle, and a plurality of outer-teeth receiving slots arranged to engage with the teeth of a dial, and wherein the dials can be removed from cylindrical surface by aligning the opening gaps of the clutches with the extended protrusions of the spindle so as to allow the spindle to move upward when the shackle moves upward;

moving the shackle upward to change the shackle from the first shackle position to the second shackle position;

removing the top body from the top portion; and disengaging the teeth of the dials from the outer-teeth receiving slots of the clutches.

* * * * *